United States Patent [19]

Wabeke, deceased

[11] Patent Number: 4,707,980

[45] Date of Patent: Nov. 24, 1987

[54] POWER PRODUCTION PROCESS THAT REDUCES ACID RAIN

[75] Inventor: Samuel Wabeke, deceased, late of Wyoming, Mich., by Hilda Wabeke, heir

[73] Assignee: James A. Wabeke et al., Grand Rapids, Mich.

[21] Appl. No.: 711,286

[22] Filed: Mar. 13, 1985

[51] Int. Cl.[4] ..... C06D 5/00

[52] U.S. Cl. ..... 60/206; 60/205; 60/645

[58] Field of Search ..... 60/205, 645, 206; 431/332

[56] References Cited

U.S. PATENT DOCUMENTS

| | | | |
|---|---|---|---|
| 927,644 | 7/1909 | Doherty | 60/649 |
| 939,570 | 11/1909 | Tone | 60/205 X |
| 1,010,768 | 12/1911 | Isaacs | 60/649 |
| 1,637,619 | 8/1927 | Lucas | 23/48 |
| 2,789,881 | 4/1957 | Hochmuth | 23/48 |
| 2,982,864 | 5/1961 | Furreboe | 290/2 |
| 3,498,752 | 3/1970 | Kuo | 23/239 |
| 3,516,880 | 6/1970 | Johnson | 149/2 |
| 3,554,515 | 1/1971 | Tonooka | 266/13 |
| 3,942,976 | 3/1976 | Cornell | 75/23 |
| 3,948,700 | 4/1976 | Ayers et al. | 149/87 X |
| 3,961,576 | 6/1976 | Montgomery, Jr. | 102/491 |
| 4,062,485 | 12/1977 | Andersen | 294/86.1 X |
| 4,087,591 | 5/1978 | Bowers et al. | 429/103 X |
| 4,128,522 | 12/1978 | Elam | 427/259 X |
| 4,129,003 | 12/1978 | Smith, Jr. | 60/645 |
| 4,216,721 | 8/1980 | Marziano et al. | 102/306 |
| 4,248,048 | 2/1981 | Smith, Jr. | 60/645 |
| 4,396,422 | 8/1983 | Matsuno et al. | 75/24 |
| 4,412,421 | 11/1983 | Smith, Jr. | 60/645 X |
| 4,418,540 | 12/1983 | Kasparian et al. | 60/649 |
| 4,432,204 | 2/1984 | Walsh | 60/517 X |
| 4,432,815 | 2/1984 | Frankel et al. | 149/19.3 |
| 4,549,396 | 10/1985 | Garwood et al. | 60/39.02 |

*Primary Examiner*—Peter A. Nelson

*Attorney, Agent, or Firm*—Price, Heneveld, Cooper, DeWitt & Litton

[57] ABSTRACT

The specification discloses a method and apparatus for generating electricity which substantially eliminates the problem of acid rain as well as the problems associated with nuclear and hydroelectric power. Scrap aluminum and ferric oxide are reacted in a combustion chamber. The heat of the reaction as well as the heat of molten iron flowing from the combustion chamber heats boilers, the generated gas of which is used to drive electric generators. The iron is reoxidized, with the heat of reoxidation also being used to heat boilers which drive generators. The reoxidized iron is then recycled into the combustion chamber.

15 Claims, 1 Drawing Figure

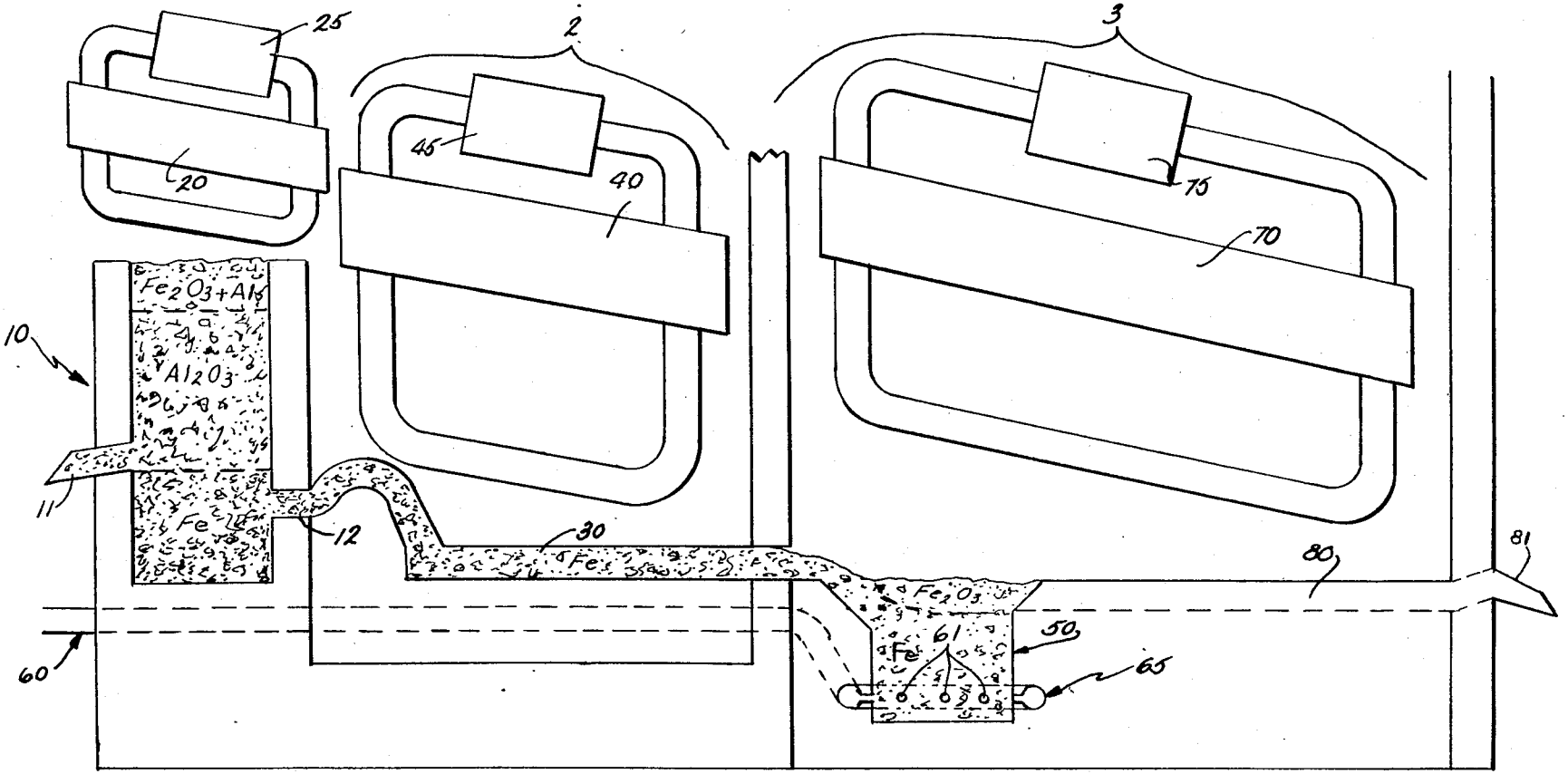
81
80
70
75
3
65
50
61
Fe
$Fe_2O_3$
40
2
45
30
25
20
12
$Fe_2O_3+Al_2O_3$
10
11
60

POWER PRODUCTION PROCESS THAT REDUCES ACID RAIN

BACKGROUND OF THE INVENTION

The present invention relates to the generation of electricity. The primary sources of energy for the generation of electricity are coal, petroleum products, nuclear fuel and hydroelectric dams.

The use of coal as a source of energy for the generation of electricity is being severely criticized due to the belief that the products of its combustion generate excessive amounts of acid rain. The use of petroleum fuels, including natural gas, is also suspect in this regard. The acid rains lead to the defoliation of forests and the pollution of lakes.

Nuclear energy presents a clean alternative to coal and petroleum products, but unfortunately not an inexpensive one. The high cost of building nuclear facilities and concerns for the hazards involved has severely hampered the nuclear power industry in the United States.

Hydroelectric power cannot answer all of the above concerns. First, there are a limited number of places at which hydroelectric dams can be installed in such a manner as to generate economical electricity. Secondly, the dams themselves generate their own environmental problems. Further, the collection of silt and the like behind the dams may eventually lead to their being unuseable.

The need for alternative sources of energy for the generation of electricity is well recognized due to the magnitude of the acid rain problem and the limitations of currently available alternatives. To date, those alternatives have not been forthcoming.

SUMMARY OF THE INVENTION

The present invention involves the generation of electrical energy by reacting aluminum, preferably scrap aluminum, with ferric oxide and using the heat thus generated as the energy source for driving electrical generators. Preferably, the iron produced as a result of the aluminum-ferric oxide reaction is reoxidized. This generates additional heat which can be further used to drive electrical generators. The resulting iron oxide is then recycled and re-reacted with additional quantities of aluminum.

The reaction of aluminum with ferric oxide generates only aluminum oxide and iron. No gaseous by-products are given off which would lead to pollution problems such as acid rain. While it is conceivable that some iron ore might contain limited quantities of sulfur, as for example in the form of iron pyrite, the potential for sulfur dioxide pollution would be extremely small as compared to coal. Further, all of such sulfurous pollution would be exhausted during the first burn of the iron oxide and would be no problem with recycled ferric oxide obtained when following the most preferred embodiment of the invention.

These and other objects, advantages and features of the present invention will be more fully understood and appreciated by reference to the written specification and appended drawings.

BRIEF DESCRIPTION OF THE DRAWINGS

FIG. 1 is a schematic illustration of the present invention.

DESCRIPTION OF THE PREFERRED EMBODIMENT

In the preferred embodiment, ferric oxide and scrap aluminum are ignited in a combustion chamber 10 (FIG. 1) with the heat of combustion generating steam or equivalent gas in boiler 20 for driving generator 25. Molten iron resulting from the reaction of ferric oxide and aluminum flows through conduit 30 and the heat thereof generates steam or equivalent gas in a second boiler 40 for driving generator 45. The molten iron continues to flow to a reoxidation chamber 50 where it is oxidized by air which is delivered to the reoxidation chamber through an air delivery system 60. The additional heat generated in the reoxidation of the iron to ferric oxide is used to heat a third boiler 70, for driving generator 75. The molten slag passes through a conduit or the like 80 which continues to heat boiler 70 until it exits at 81 for reintroduction into the combustion chamber 10.

The basic reaction used in the present invention is as follows:

$$AL_2O_3+2Fe \rightarrow Fe_2O_3+2AL$$

The heat of combustion of the ferric oxide and aluminum is approximately 2,800° C. The energy released per ton of iron is approximately 6,348,000 BTU. The principal reaction itself gives no gaseous by-products. Impurities in the ingredients might of course lead to some gaseous by-products. However such impurities in the ferric oxide will be expelled on the first burn and will not appear in the recycled ferric oxide.

The aluminum used is preferably scrap aluminum or aluminum smelting residue. Aluminum smelting residue is formed on molten aluminum in the refining of metallic aluminum, in melting treatment of scrap aluminum and in the manufacture of aluminum alloy. While aluminum smelting residue does contain alumina, it also contains some metallic aluminum which is available for the principal reaction of the present invention. The scrap aluminum and/or smelting residue is preferably pulverized and then screened so that the feed can be controlled.

Iron ore is of course a primary ferric oxide source. The ferric oxide can also be obtained from "scale" formed during the drawing of steel billet in a continuous casting operation, during the rolling or forging of steel billet or ingot, or during the heat treatment of a steel billet or ingot. This scale is in the form of a film or sheet which contains ferric oxide as a main component. It may be desirable to pelletize the ferric oxide to enhance the ease of handling same when introducing them into combustion chamber 10.

The furnace or combustion chamber 10 into which the aluminum and ferric oxide are charged can be made of conventional refractory material. The material selected must be able to resist the extremely high temperatures of molten iron and aluminum and the extremely high temperatures generated as a result of the primary reaction. Temperatures as high as 2,800° C. could be generated.

Furnace 10 is provided with a first outlet 11 at something of a midpoint down its height and a second outlet 12 towards the bottom of furnace 10. As the principal reaction proceeds, molten iron will tend to sink to the bottom of furnace 10 as indicated in FIG. 1. Aluminum oxide formed in the reaction will tend to float on top of the iron and form an intermediate layer in furnace 10.

Iron oxide and aluminum, as they are added, will tend to react on top of the aluminum oxide. First outlet 11 should be located at a height such that the aluminum oxide slag can be drawn off through outlet 11. Outlet 12 should be located farther down so that molten iron can be drawn off from the bottom of furnace 10.

In order to keep the temperature of the molten iron below the boiling point of the iron, i.e., approximately 2,450° C., it may be necessary to add scrap iron to the combustion chamber 10.

Combustion chamber 10 can include any type of conventional means for initiating the reaction of ferric oxide and aluminum. A conventional electric arc means might be employed for this purpose. Other conventional ignition devices could be used.

Boiler 20 can be conventional in construction. It is coupled to combustion chamber 10 in a conventional manner. This coupling is shown only schematically in FIG. 1, since this is conventional technology and is not critical to the present invention.

The material vaporized in boiler 20 can be water or some other liquid. One possibility would be to generate steam in boiler 20 and provide an exchange loop between the steam and a freon loop, whereby freon would actually be used to drive an electrical generator 25. A steam turbine generator can also be directly driven by steam generated in boiler 20.

The aluminum oxide slag drawn through exit port 11 can be recycled to an aluminum producer where it can be converted to aluminum again for use in the manufacture of aluminum products.

The molten iron flowing out through port 12 flows through a molten iron conduit means 30 in a boiler room 2 located adjacent combustion chamber 10. Conduit means 30 are comprised of a high temperature material. It may consist of a series of pipes made of a refractory material or even a series of open channels. It is not critical that the molten iron actually be enclosed.

A second boiler 40 is operably coupled to the molten iron conduit means 30 in order that the heat of the molten iron can be used to generate additional steam. Boiler 40 is conventional, as is boiler 20. Steam generated in boiler 40 can be used to drive additional electrical generators 45, either directly or through a heat exchanger loop with a freon loop or the like.

Molten iron continues to flow through molten conduit 30 and out into a reoxidation chamber 50 located in another boiler room 3. Reoxidation chamber 50 is composed of a high heat resistant refractory material. Air is pumped through an air pipe 60 or series of such pipes which include ports 61 opening into the bottom of reoxidation chamber 50. Preferably, air conduit means 60 passes adjacent or perhaps through the wall of combustion chamber 10 so that air pumped therethrough is heated. This preheated air will help avoid the possibility of cooling the molten iron to its solidification temperature.

This air is bubbled up through the molten iron in reoxidation chamber 50 and the oxygen in the air reoxidizes the molten iron to ferric oxide. Considerable heat is generated as a result of the following reoxidation reaction:

$$4Fe+3O_2 \rightarrow 2Fe_2O_3$$

Approximately 784 BTU are generated per pound mole of iron. This heat is used to heat a third boiler 70, which is conventional and which is coupled to the heat source in a conventional manner. Boiler 70 is used to drive additional electrical generators 75 in the manner described herebefore.

The ferric oxide slag is floated out through slag conduit 80 and through an exit port 81 to a water cooling tank. It will probably be necessary to allow some molten iron to flow through slag conduit 80 to keep the iron oxide slag moving. Slag conduit 80 can be of the same construction as molten iron conduit means 30. The cooled ferric oxide can then be reground, sized or possibly pelletized, and reintroduced into combustion chamber 10.

Of course, it is understood that the above is merely a preferred embodiment and that various changes and alterations can be made without departing from the spirit and broader aspects thereof. Further, it will of course be appreciated by those skilled in the art that routine, but detailed engineering will be required to apply the principles of the invention and apparatus as set forth above.

The embodiments of the invention in which an exclusive property or privilege is claimed are defined are as follows.

1. A method for generating electricity comprising:
initiating a reaction of aluminum with ferric oxide in a combustion chamber;
adding aluminum and ferric oxide to said combustion chamber to sustain said reaction;
using the heat generated by said reaction to fire a boiler;
using the gas generated in the boiler to operably drive an electrical generator, whereby the molten iron resulting from the reaction will sink to the bottom of said combustion chamber, the aluminum oxide resulting from the reaction will float on top of the iron in an intermediate layer and the added iron oxide and aluminum will tend to react on top of aluminum oxide, and drawing molten iron from said combustion chamber an converting said iron to oxide form.

2. The method of claim 1 which includes:
drawing molten iron out of said combustion chamber;
operably associating a second boiler means with said molten iron whereby gas is generated in said second boiler; and
using said gas to drive electrical generator means.

3. A method for generating electricity comprising:
reacting aluminum with ferric oxide in a combustion chamber;
using the heat thus generated to fire a first boiler;
using the gas generated in the first boiler to operably drive an electrical generator;
drawing molten iron out of said combustion chamber;
operably associating a second boiler means with said molten iron whereby gas is generated in said second boiler;
using the gas generated in the second boiler to drive electrical generator means conveying said molten iron to a reoxidation chamber;
forcing air through said molten iron in said reoxidation chamber to thereby reoxidize molten iron to ferric oxide; and
reusing said ferric oxide in said combustion chamber.

4. The method of claim 3 in which boiler means are operably associated with said reoxidation chamber whereby the heat of reoxidation is used to generate a gas in said boiler;
using said gas to drive electrical generator means.

5. The method of claim 4 in which the aluminum used in said reaction comes at least in part from one of the following:

scrap aluminum, aluminum smelting residue and combinations thereof.

6. The method of claim 5 in which the ferric oxide used in said reaction comes at least in part from one of the following sources:

iron ore, scale and combinations thereof.

7. A method for generating electricity comprising:

reacting aluminum with ferric oxide in a combustion chamber;

using the heat thus generated to fire a boiler;

using the gas generated in the boiler to operably drive an electrical generator;

withdrawing molten iron from said combustion chamber and conveying said molten iron to a reoxidation chamber;

forcing air through said molten iron in said reoxidation chamber to reoxidize said molten iron to ferric oxide; and reusing said ferric oxide in said combustion chamber in said reaction of aluminum and ferric oxide.

8. The method of claim 7 in which boiler means are operably associated with said reoxidation chamber whereby the heat of reoxidation is used to generate a gas in said boiler;

using said gas to drive electrical generator means.

9. The method of claim 8 in which the aluminum used in said reaction comes at least in part from one of the following:

scrap aluminum, aluminum smelting residue and combinations thereof

10. The method of claim 9 in which the ferric oxide used in said reaction comes at least in part from one of the following sources:

iron ore, scale and combinations thereof.

11. Apparatus for generating electricity comprising:

a combustion chamber made of a material capable of withstanding the heat of reaction of aluminum and ferric oxide;

boiler means associated with said combustion chamber for generating a gas;

generator means operably connected with said boiler means whereby the gas generated in said boiler means drives said generator to generate electricity;

a reoxidation chamber connected to said combustion chamber;

said reoxidation chamber including openings therein through which air can be delivered, whereby molten iron can be withdrawn from said combustion chamber into said reoxidation chamber and there reoxidized to ferric oxide by forcing air through said molten iron.

12. The apparatus of claim 11 which includes further boiler means operably connected with said reoxidation chamber whereby the heat of reoxidation can be used to generate gas in said further boiler means;

additional electrical generating means operably connected with said further boiler means whereby the gas generated in said further boiler means can be used to drive said additional electrical generating means.

13. The apparatus of claim 12 which includes molten iron conveyor means extending from said combustion chamber to said reoxidation chamber;

third boiler means being operably connected with said molten iron conveying means whereby the heat of said molten iron generates further gas in said third boiler means;

third electrical generator means being operably connected to said third boiler means whereby gas generated in said third boiler means drives said third electrical generator means.

14. The method of claim 1 wherein the aluminum used in said reaction comes at least in part from one of the following: scrap aluminum, aluminum smelting residue and combinations thereof.

15. The method of claim 1 in which the ferric oxide used in said reaction comes at least in part from one of the following sources:

iron ore, scale and combinations thereof.

* * * * *